US005462151A

United States Patent [19]

Furneaux

[11] Patent Number: 5,462,151

[45] Date of Patent: Oct. 31, 1995

[54] METHOD AND APPARATUS FOR COIN VALIDATION

[75] Inventor: David M. Furneaux, Maidenhead, United Kingdom

[73] Assignee: Mars, Incorporated, McLean, Va.

[21] Appl. No.: 104,038

[22] PCT Filed: Feb. 27, 1992

[86] PCT No.: PCT/GB92/00354

§ 371 Date: Aug. 4, 1993

§ 102(e) Date: Aug. 4, 1993

[87] PCT Pub. No.: WO92/15970

PCT Pub. Date: Sep. 17, 1992

[30] Foreign Application Priority Data

Feb. 27, 1991 [GB] United Kingdom ..... 9104069

[51] Int. Cl.[6] ..... G07D 5/08

[52] U.S. Cl. ..... 194/318

[58] Field of Search ..... 194/317, 318, 194/319

[56] References Cited

U.S. PATENT DOCUMENTS 3,749,220 7/1973 Tabiichi et al. .
3,901,367 8/1975 Miyazawa .
4,742,903 5/1988 Trummer ..... 194/317

FOREIGN PATENT DOCUMENTS 0062411 10/1982 European Pat. Off. .
2049252 12/1980 United Kingdom .
2092798 8/1982 United Kingdom ..... 194/319
2211337 6/1989 United Kingdom .

*Primary Examiner*—F. J. Bartuska
*Attorney, Agent, or Firm*—Davis Hoxie Faithfull & Hapgood

[57] ABSTRACT

A system for validating coins comprises a transmitter coil for transmitting low-frequency electromagnetic radiation through a coin to be validated and a receiver coil for receiving radiation having passed through the coin. An inverting amplifier is provided in a feedback path between the receiver coil and the transmitter coil thereby providing a 180° phase shift. Thus, for the unique frequency which causes a 180° phase shift within the coin, there is provided positive feedback, and a resonance condition occurs at that frequency. By measuring the frequency of this resonance and comparing it with a reference value, the coin can be validated.

11 Claims, 4 Drawing Sheets

METHOD AND APPARATUS FOR COIN VALIDATION

FIELD OF THE INVENTION

The present invention relates generally to coin validation.

BACKGROUND OF THE INVENTION

More specifically the present invention concerns coin validation using the phase shift caused by a coin to be validated which occurs when electromagnetic radiation is applied to the coin. A desirable feature of systems employing such a technique is that the phase shift, for a given frequency of radiation, is dependent mainly on the thickness and material of the coin and only to a small extent, if at all, on the lateral position of the coin relative to the validating apparatus or on features of the validating apparatus itself.

An example of a known system of the above type is described in British Patent GB 1443945, in the name of the present applicant. In this system a coin to be tested is caused to pass between a transmitting coil and a receiving coil. An oscillator supplies the transmitting coil with low-frequency, e.g. 320 kHz, electromagnetic radiation. The receiving coil receives electromagnetic radiation which, as a result of the presence of the coin, is phase-shifted with respect to the oscillator output. The phase of the oscillator is compared with that of the output signal from the receiving coil, and the phase difference is compared with a reference value to determine whether or not the coin is deemed to be valid.

However, in the above system the magnitude of the phase shift at the receiving coil is dependent on the oscillator frequency. Thus, any instability in the oscillator frequency will result in a different phase change to be expected for a valid coin.

In order to compensate for this effect, it is possible to measure the oscillator frequency and to determine a suitable phase shift reference value in dependence on the measured frequency. Such a system is described in EP-A2-0110510, also in the name of the present applicant. Since the phase shift is dependent, for a given coin, mainly on the oscillator frequency, this system has the advantage that it is merely necessary to measure the frequency in addition to performing the phase comparison to obtain a reliable validation. In particular, no adjustments are needed to compensate for tolerance of the components. However, for each value of measured frequency, an appropriate phase shift reference value must be generated, which will involve either the need for storing a table of frequencies and corresponding phase shift values or, alternatively, the need for the system to run an algorithm program for converting frequency values into corresponding values of phase shift.

It would be desirable to provide a system for coin validation based on the phase shift across a coin to be tested, and thereby exhibiting the advantages of the above-mentioned systems, but which does not produce errors in validation arising from variations in oscillator frequency, and does not require the provision of stored values for the frequency and phase shift correlation or the storage and execution of an algorithm for determining a reference phase shift Value from a given measured frequency.

Furthermore, it would be desirable to provide such a system which is not limited to a single frequency, so that the full range of coin thicknesses and conductivities can be encompassed.

SUMMARY OF THE INVENTION

According to a first aspect of the present invention there is provided a coin validator having a validation circuit comprising:

means for transmitting electromagnetic radiation;

means for receiving the radiation, the arrangement being such that a coin to be validated can be positioned so as to shift the phase of the radiation received by the receiving means; and a feedback path from the receiving means to the transmitting means, so that the validation circuit oscillates at a frequency dependent upon the properties of the coin, wherein the circuit is arranged to oscillate when the coin shifts the phase of the radiation received by 180°.

It will be appreciated that such a validator has the major advantage that, for a given value of the phase shift, validation can be achieved by measurement of a single frequency value and that this frequency value does not depend on the nature of the particular validator apparatus used.

A further advantage of such a system is that frequency is a parameter which can easily be measured accurately, resulting in a high level of discrimination.

It is preferred that the 180° phase shift is provided by a phase shifter in the feedback path, since this can be in the form of an inverter which will produce a consistent phase shift (180°) over a wide range of frequencies. Thus, oscillation occurs when the phase shift across the coin is also 180°. This has the further advantage that leakage flux, i.e. that received by the receiver without having passed through the coin, cannot introduce significant errors in the determined phase shift. As will be explained in detail below, if any other value of phase shift were chosen, any leakage flux would combine with that having passed through the coin and therefore change the phase shift. This results from the fact that, only with a 180° phase shift will the leakage radiation always be in antiphase with respect to the transmitted radiation, thus affecting only the amplitude and not the phase of the received signal.

In some situations, the leakage flux may be so great compared with that transmitted, that it completely masks the transmitted radiation. Such a situation might occur, for example, with coins of small diameter and/or which are made from material which strongly absorbs electromagnetic radiation in the frequency range used, e.g. magnetic material. To overcome this problem, the receiver output may be combined with a signal having the same frequency as the oscillator output, but of opposite phase. For example, a small amount of the oscillator output may be fed directly in antiphase to the receiver. This could be achieved by providing a second receiving coil in series opposition with the main receiving coil and which is positioned so as to receive radiation direct from the transmitting coil without having passed through the coin. Alternatively, a signal from the oscillator may be fed directly to the negative input of a subtracter, the positive input of which is supplied with the output from the main receiving coil.

In accordance with a second aspect of the present invention there is provided a method of validating coins comprising:

transmitting electromagnetic radiation;

receiving the radiation;

positioning a coin to be validated so as to shift the phase of the received radiation; and feeding back a signal derived from the received radiation so that the signal influences the transmitted radiation, such that oscillation occurs at a frequency dependent upon the properties of the coin, wherein oscillation occurs when the coin shifts the phase of the radiation received by 180°.

BRIEF DESCRIPTION OF THE DRAWINGS

In order that the invention will be fully understood, non-limiting embodiments thereof will now be described with reference to the accompanying drawings, wherein.

DETAILED DESCRIPTION OF THE INVENTION

Figure 1:
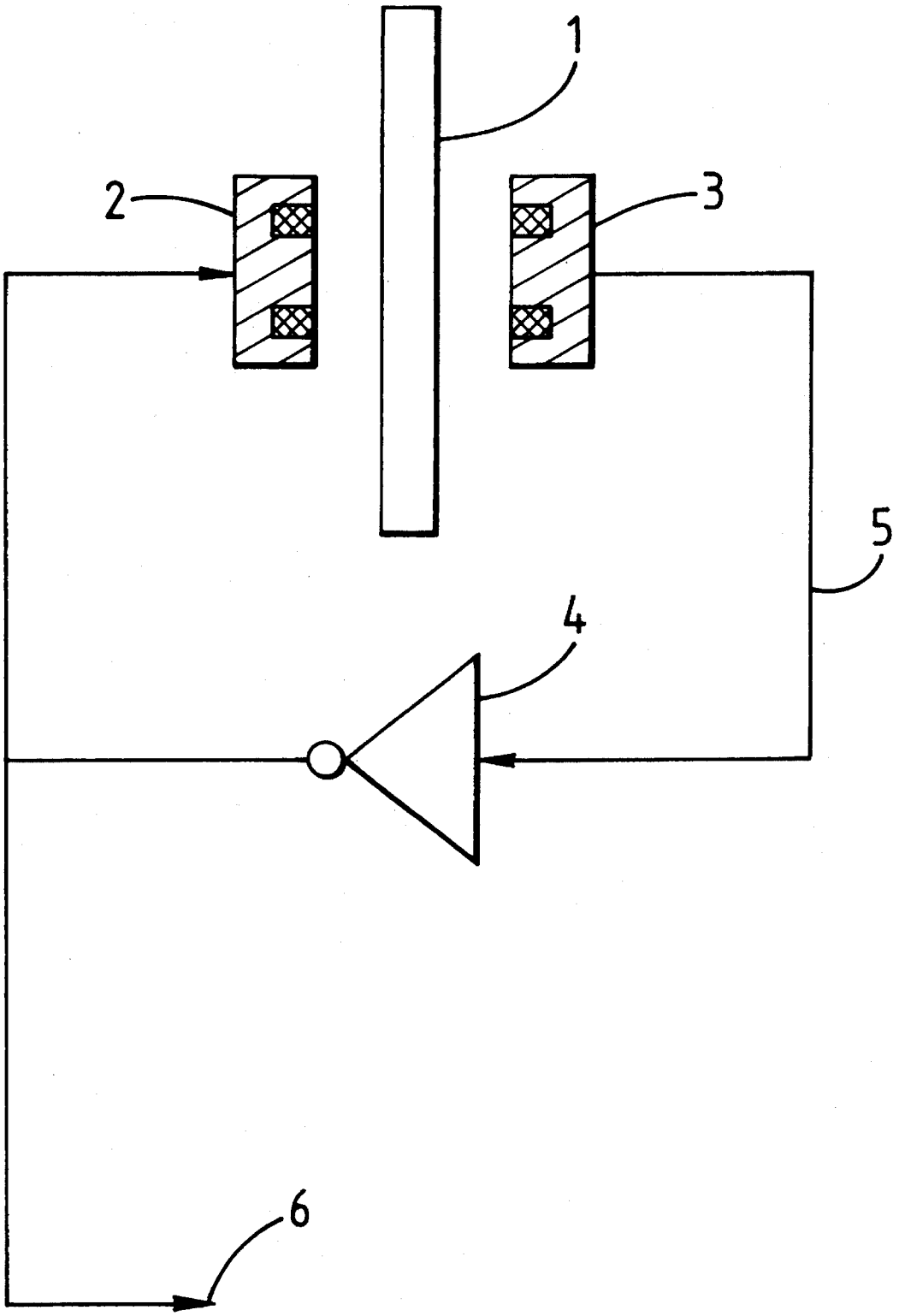
FIG. 1 shows in schematic form a preferred embodiment of the present invention.

With reference to FIG. 1, a coin 1 is caused to pass between a transmitter coil 2 and a receiver coil 3. The output from receiver coil 3 is connected to the input of an inverting amplifier 4 the output of which is connected to the transmitter coil 2. The inverting circuit 4 serves to provide negative feedback from the receiver coil 3 to the transmitter coil 2, as a consequence of which, in the absence of a coin, most noise in the inverting amplifier 4 will tend to be suppressed because of the negative feedback. However, when a coin is caused to pass between the transmitter coil 2 and receiver coil 3, a phase shift is introduced by the coin, and the amount of this phase shift depends on the frequency of electromagnetic radiation transmitted. Any noise occurring at the frequency at which the coin produces a phase shift of 180° will be reinforced by the feedback loop, since, at this frequency, there will be positive feedback. Oscillation at this frequency is found to occur very shortly after a coin enters the space between the transmitter coil 2 and the receiver coil 3. The frequency at which such oscillation occurs is a direct measure of the thickness and material of the coin being tested and does nor depend significantly upon any circuit parameter. Thus, for a given coin type, a frequency range may be selected such that a coin will be deemed valid if it produces an oscillation at a frequency within this range and invalid if the frequency is outside the range. To effect validation, the frequency of oscillation appearing at the output terminal 6 is measured and compared with a reference frequency (which will in general be different for different coin types). Frequency can be measured, for example, by counting the number of cycles in the oscillation occurring between two clock pulses separated by a known time interval. Alternatively, for lower frequencies, the number of high-frequency clock pulses (of known frequency) occurring between two adjacent cycles of oscillation can be counted. Validation could, for example, be based on whether the measured frequency lies within a predetermined frequency range central about the reference frequency. Alternatively, the frequency range could be defined by two reference values supplied to a comparator to establish a frequency window.

Figure 2:
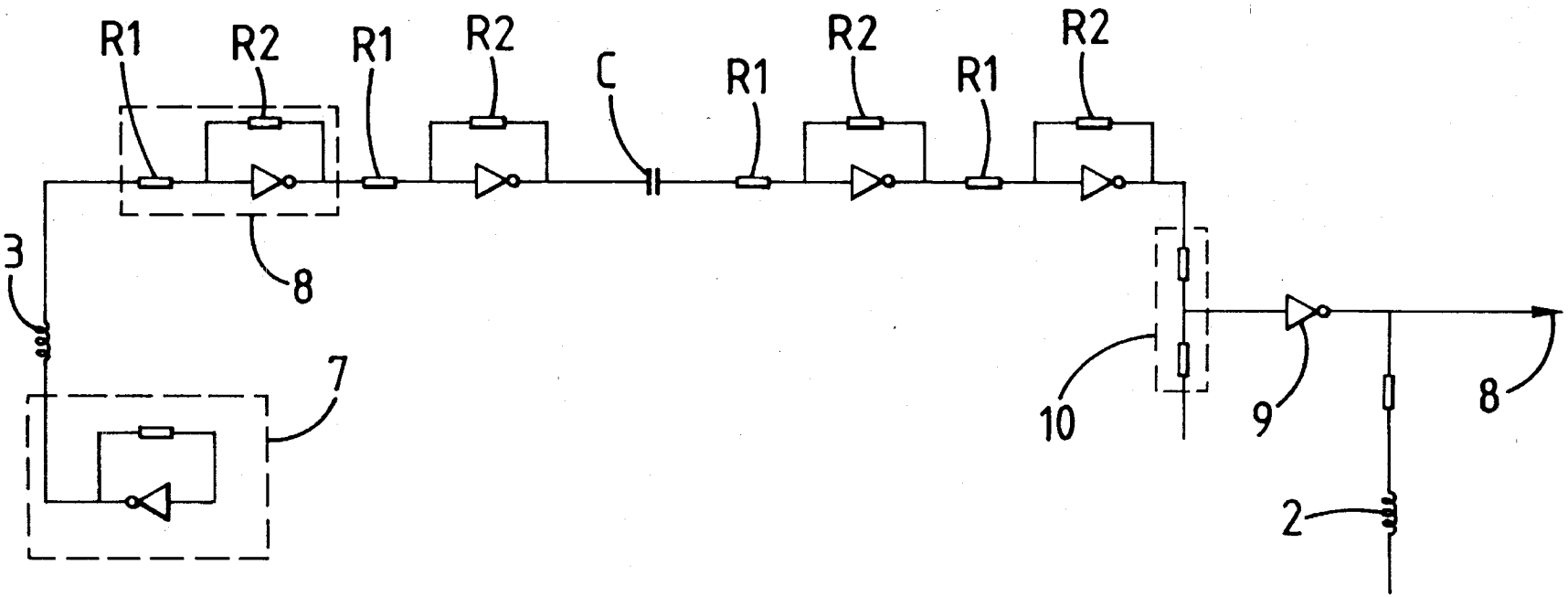
FIG. 2 is a circuit diagram for the system shown in FIG. 1.

It will be clear from the above that, for the system to function effectively, the inverting amplifier 4 should exhibit a gain larger than the highest coin attenuation and provide an accurate phase shift of 180°. This can be achieved if the inverting amplifier 4 is a limiting amplifier or an automatic gain control amplifier incorporating digital gates. Such an arrangement is shown schematically in FIG. 2, which includes a plurality of amplifiers of similar structure, one of the amplifiers being shown at 8 and comprising a logic inverter with two resistors, .connected in series. The combination 7 of a gate and feedback resistor connected to one end of the receiver coil 3 serves to generate a DC offset voltage at the input of amplifier 8 which is connected to the other end of the receiver coil 3. The gain of each gate is—R2/R1 where R1 and R2 are the resistance values of the corresponding resisters shown in FIG. 2 with capacitive coupling provided by capacitor C to remove any adverse effect of different gate thresholds producing a DC offset at the output. Inverter 9 provides the high output current needed to drive the transmitter coil 2. Since inverter 9 operates at a lower logic voltage from that of the other gates, a potential divider 10 is provided to reduce the input voltage. The output of inverter 9 is supplied to the transmitter coil 2 the output of which is supplied to an output terminal 6 connected to a frequency-measuring device (not shown).

When a current is induced in a coin by the transmitter coil 2, the magnitude of the current diminishes as it penetrates into the coin. This effect is called the skin effect and is governed by the following equation:

$$\delta = \frac{1}{\sqrt{(\pi\mu\sigma f)}}$$

where 8 is the skin depth, i.e. the depth at which the current density is 1/e i.e. approximately 37% of the value at the surface of the coin, $\mu$ is the magnetic permeability of the coin material, $\sigma$ is the conductivity of the coin material and f is the frequency of electromagnetic radiation.

It can be seen that the skin depth decreases with increasing frequency, with increasing conductivity and with increasing permeability. Examples of skin depths for different materials at 100 kHz are as follows:

Copper 0.22 mm
Cupro-Nickel 0.8 mm
Brass 0.4 mm
Nickel 0.04 mm
Steel 0.03 mm

The phase of the electromagnetic radiation also changes with penetration into the coin. The phase shift is equal to one radian per skin depth $\delta$, the variation being linear. The above equation is appropriate for currents penetrating into an infinitely thick specimen and therefore only approximate for coins having a thickness comparable to the skin depth. However, the inverse dependence of skin depth on frequency is still applicable. Thus, for a given phase shift $\phi$ across the coin, the thickness t of the coin is:

$$t = \phi\delta = \frac{\phi}{\sqrt{(\pi\mu\sigma f)}}$$

and it can be seen that the measured frequency f will depend only on the thickness of the coin and the electromagnetic properties of the coin material.

As mentioned above, in the present invention, the phase shift across the coin to be tested is 180° and it can be seen from the following why such a choice is advantageous.

Figure 3:
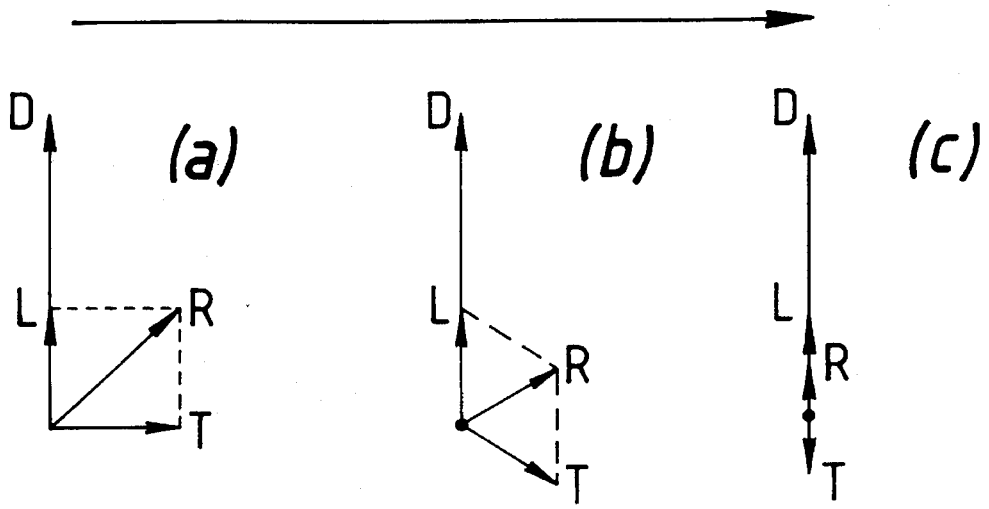
FIGS. 3 and 4 are diagrams for use in explaining the advantages associated with a 180° phase shift.

FIG. 3 is a phasor diagram showing the effect of frequency, increasing in the direction of the arrow, on the amplitude and phase of the radiation T transmitted through the coin. At a first, low, frequency (FIG. 3(*a*)), it can be seen that the phase of the transmitted radiation T is 90° with respect to the driving radiation D (i.e. the radiation produced by the transmitter coil), but, in the presence of leakage flux L, the radiation R actually received by the receiver coil will exhibit a smaller phase shift than that transmitted through the coin. This is because the received radiation comprises the sum of the transmitted radiation having a first phase and the leakage radiation having a second, different, phase. As the frequency increases (FIG. 3(*b*)), so does the phase shift exhibited by both the radiation T which has passed through the coin and the radiation R actually received by the receiver coil. However, the amplitude of the transmitted radiation decreases. At a critical point (FIG. 3(*c*)), the phase shift introduced by the coin will be 180°, and the actual radiation R received by the receiver coil will either be in phase or in antiphase with that radiated by the transmitter coil. At this point the transmitted radiation T is of relatively low amplitude and, if it is lower than the amplitude of the received leakage radiation L, then the received radiation R .is in phase with the driving radiation D, and oscillation will not occur.

Figure 4:
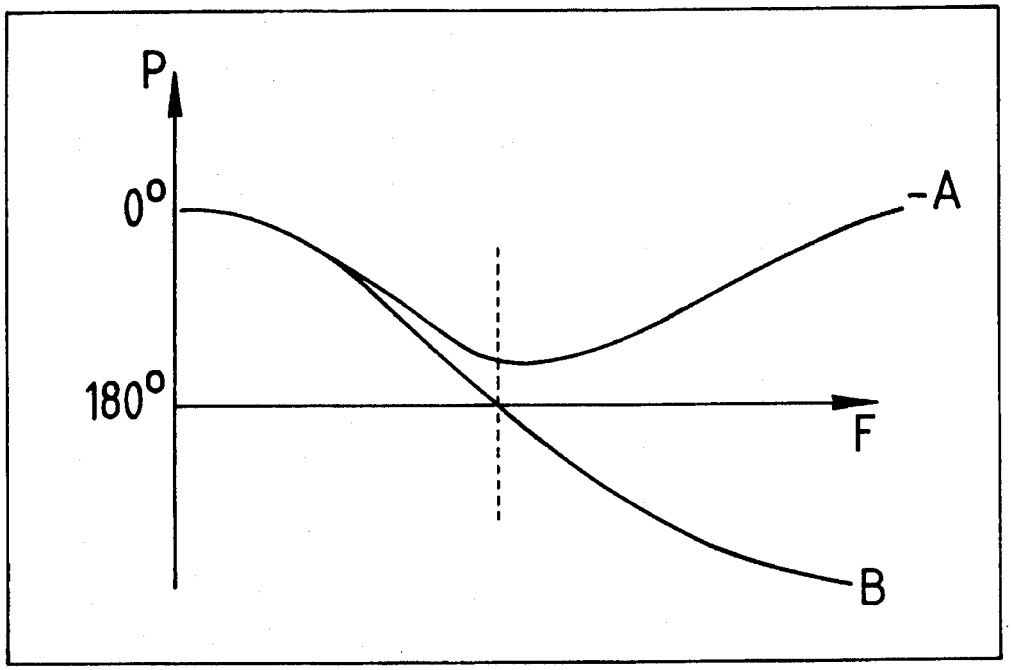

FIG. 4 is a graph of phase shift P of the received signal versus frequency F, and it can be seen that coins exhibiting low transmission attenuation will, at some frequency, produce a 180° phase shift in the received signal (see curve B). If the attenuation of the coin is high then insufficient transmission at this 180° phase shift will pass through the coin, so that the received signal will not exhibit this 180° phase shift and oscillation will not be possible (see curve A). However, it is important to note that, although high attenuation coins will not give rise to a 180° phase shift, the effect of the leakage radiation does not give rise to an error in the frequency measurement, i.e. either an antiphase relationship exists, in which case oscillation occurs, and the frequency can be measured accurately, or it does not, in which case, in the absence of compensation, no measurement is possible, because there is no oscillation.

If there is a small amount of transmitted radiation but this is masked by the leakage radiation, it is possible to compensate for the leakage radiation and thereby still obtain an accurate measurement of the resonance frequency.

Figure 5:
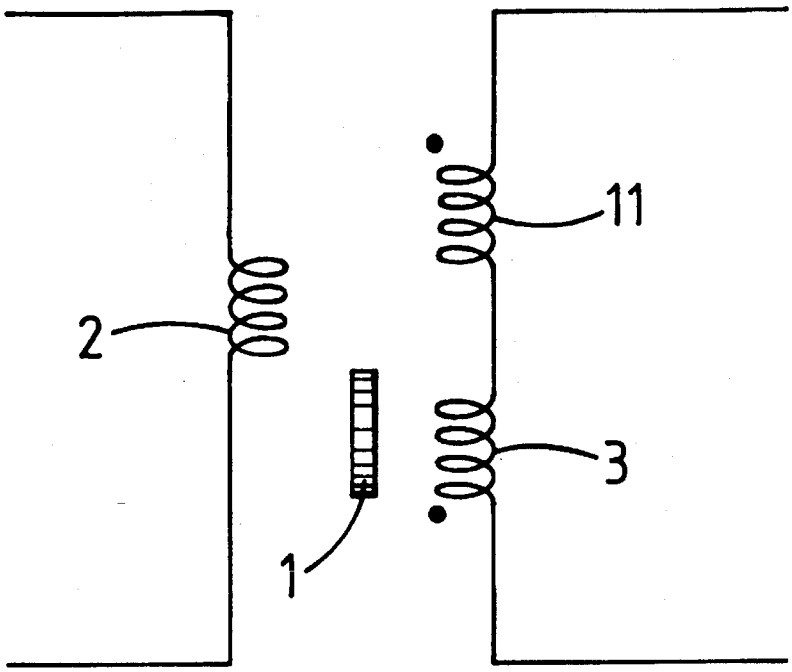
FIG. 5 illustrates a first system for compensating for effects of leakage radiation.

FIG. 5 shows a first method for compensating for the effect of such high leakage radiation. In addition to the main receiver coil 3, there is provided, connected in series opposition thereto, a second receiver coil 11 which receives radiation directly from the transmitter coil 2 without having passed through the coin 1. The series opposition connection effectively adds an out-of-phase signal to that produced by the main receiver coil 3 so as to reduce the effect of the in-phase leakage radiation received by the main receiver coil. The effect of leakage radiation is thus reduced so as to enable oscillation to occur, and the frequency associated with the 180° phase shift across the coin can be measured.

Figure 6:
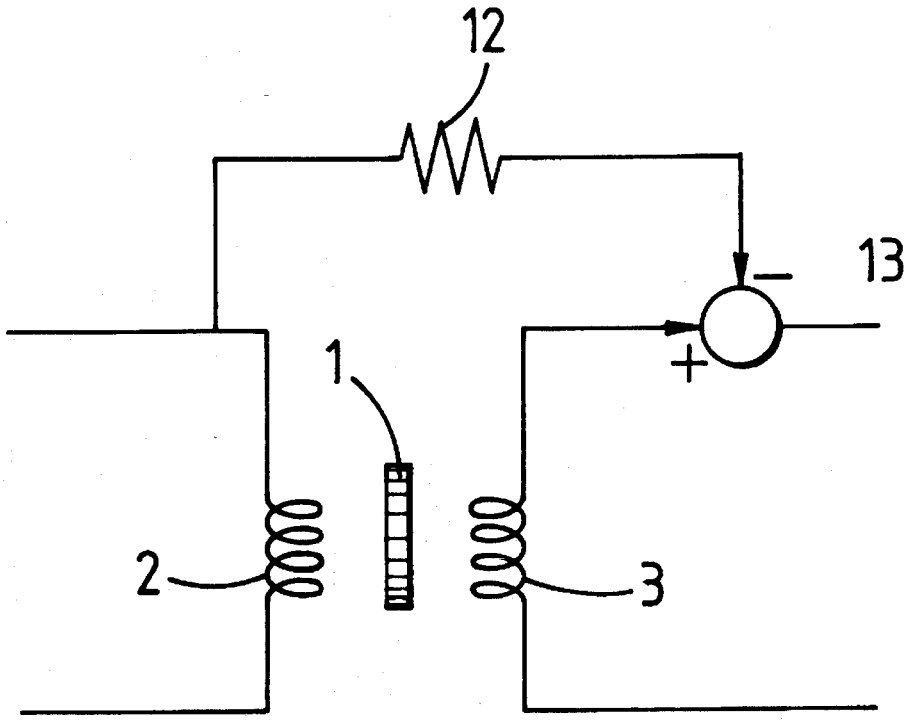
FIG. 6 illustrates a second system for compensating for the effects of leakage radiation.

A second method of achieving compensation for leakage radiation is shown in FIG. 6. A portion of the signal feeding the transmitter coil 2 is connected, via a resistor 12, to the subtrahend (i.e. negative) input of a subtracter 13, to the positive input of which is fed the output of the receiver coil 3.

It has been found by the present applicant that, by using a validator in accordance with the present t invention, it is possible to measure the thickness of coins to a resolution of 0.025 mm for all coin materials. Thus, in the case of German 1 DM coins (rim thickness =1.75 mm; mean interior thickness—1.50 mm) and UK 5p coins (rim thickness=1.73 mm; mean interior thickness =1.62 mm), it has been found possible using such a validator to discriminate effectively between these two coin types. For example, using measurements on fifty 1 DM coins and fifty UK 5p coins, a frequency range can be selected which will cause 95% of all 1 DM coins to be accepted and 97.7% of all 5p coins to be rejected. In the case of UK 2p coins and US dollar coins, almost 100% discrimination can be achieved.

Furthermore, whilst a coil is employed in the above-described embodiment for receiving the radiation flux, any other suitable receiver could alternatively be employed such as a magnetoresistive receiver. Such a receiver has the advantage that any minor frequency-dependent phase shifts caused by using coils are avoided.

I claim:

1. A coin validator having a validation circuit comprising:

means for transmitting electromagnetic radiation;

means for receiving the radiation, the arrangement being such that a coin to be validated can be positioned so as to shift the phase of the radiation received by the receiving means; and a feedback path from the receiving means to the transmitting means, wherein the feedback path causes a phase shift of substantially 180° so that the validation circuit is arranged to oscillate when the coin shifts the phase of the radiation received by substantially 180°, and the phase shifts are independent of frequency of oscillation.

2. A coin validator as claimed in claim 1 wherein said feedback path includes an inverting amplifier.

3. A coin validator am claimed in claim 2 wherein said inverting amplifier comprises digital gates.

4. A coin validator as claimed in claim 1, further comprising means for compensating the output of the receiving means for radiation received by the receiving means which has not been phase-shifted by the coin.

5. A coin validator as claimed in claim 4, wherein said compensating means comprises means for combining the output of the receiving means with a signal having the same frequency as the oscillation frequency but of opposite phase to that transmitted by said transmitting means.

6. A coin validator as claimed in claim 5, wherein said compensating means comprises a second means for receiving radiation from said transmitting means which has not been phase-shifted by the coin and said combining means is operative to combine the output of said second receiving means with the output of the first-mentioned receiving-means.

7. A coin validator as claimed in claim 5, wherein said combining means comprises a subtracter to one input of which is fed a signal from said transmitting means, the first-mentioned receiving means being connected to a second input of said substracter.

8. A method of validating coins comprising:

transmitting electromagnetic radiation;

receiving the radiation;

positioning a coin to be validated so as to shift the phase of the received radiation; and feeding back a signal derived from the received radiation, wherein the phase of the signal is shifted by substantially 180°, so that the signal influences the transmitted radiation, such that oscillation occurs at a frequency dependent upon the properties of the coin, wherein oscillation occurs when the coin shifts the phase of the radiation received by substantially 180°, and the phase shift is independent of frequency of oscillation.

9. A method of validating a coin as claimed in claim 8, further comprising the step of compensating for any radiation received which has not been transmitted through the coin.

10. A coin validator for accepting coins of a plurality of coin types, comprising:

a transmitter;

a receiver; and a feedback path coupling the transmitter to the receiver wherein the feedback path causes a phase shift of substantially 180°, such that the transmitter, receiver and feedback path form a circuit which oscillates at a frequency dependent upon the coin type of a coin positioned between the transmitter and receiver, wherein the phase shift is independent of frequency of oscillation.

11. The coin validator of claim 10, wherein the feedback path comprises an inverting amplifier.

* * * * *